US010680338B2

(12) United States Patent
Leung et al.

(10) Patent No.: US 10,680,338 B2
(45) Date of Patent: Jun. 9, 2020

(54) DIELECTRIC RESONATOR ANTENNA

(71) Applicant: City University of Hong Kong, Kowloon (HK)

(72) Inventors: Kwok Wa Leung, Kowloon Tong (HK); Lei Guo, Kowloon Tong (HK)

(73) Assignee: City University of Hong Kong, Kowloon (HK)

( * ) Notice: Subject to any disclaimer, the term of this patent is extended or adjusted under 35 U.S.C. 154(b) by 108 days.

(21) Appl. No.: 15/875,341

(22) Filed: Jan. 19, 2018

(65) Prior Publication Data

US 2019/0229424 A1 Jul. 25, 2019

(51) Int. Cl.
*H01Q 9/04* (2006.01)

(52) U.S. Cl.
CPC ..... *H01Q 9/0492* (2013.01); *H01Q 9/045* (2013.01)

(58) Field of Classification Search
CPC ..... H01Q 9/0485; H01Q 9/0492
See application file for complete search history.

(56) References Cited

U.S. PATENT DOCUMENTS 3,710,340 A 1/1973 Mayes
3,868,694 A 2/1975 Meinke
4,879,563 A 11/1989 Takeda
4,972,196 A 11/1990 Mayes
6,466,178 B1 10/2002 Muterspaugh
7,589,686 B2 9/2009 Balzovsky
7,843,389 B2 11/2010 Luk
9,419,357 B2 8/2016 Urano
2005/0017903 A1* 1/2005 Ittipiboon ..... H01Q 9/0485 343/700 MS
2010/0103061 A1 4/2010 Ning
2012/0212386 A1* 8/2012 Massie ..... H01Q 1/243 343/850
2012/0306713 A1* 12/2012 Raj ..... H01Q 9/0485 343/785
2017/0040700 A1* 2/2017 Leung ..... H01Q 9/0485
2019/0214732 A1* 7/2019 Leung ..... H01Q 1/38

* cited by examiner

*Primary Examiner* — Daniel Munoz
(74) *Attorney, Agent, or Firm* — Renner Kenner Greive Bobak Taylor & Weber

(57) ABSTRACT

A dielectric resonator antenna having a dielectric substrate with a ground plane and a dielectric resonator element arranged on the ground plane includes a conductive feeding assembly operable to excite one or more dielectric resonator modes of the dielectric resonator element for generation of a first circularly polarized electromagnetic field, and a radiating arrangement operable to produce a second circularly polarized electromagnetic field complementary to the first circularly polarized electromagnetic field. The first and second circularly polarized electromagnetic fields, when combined, are arranged to provide a unilateral circularly polarized electromagnetic field.

19 Claims, 15 Drawing Sheets yz-plane xy-plane

| | Dielectric Resonator Antenna-A Patterns | Dielectric Resonator Antenna-B Patterns | Unilateral Patterns |
|---|---|---|---|
| z y<br>*yz*-plane | | | |
| y x<br>*xy*-plane | | | |

Figure 16

DIELECTRIC RESONATOR ANTENNA

TECHNICAL FIELD

The invention relates to a dielectric resonator antenna and particularly, although not exclusively, to a unilateral circularly polarized dielectric resonator antenna that has a rather compact construction.

BACKGROUND

Unidirectional antenna has been widely investigated due to its capability of confining or concentrating radiation in a desired direction. Conventionally, complementary antenna has been used to obtain a unidirectional radiation pattern.

A unidirectional radiation pattern can be broadly classified into two types: broadside radiation and lateral radiation. For broadside radiation, magneto-electric dipoles have been used in various applications including wideband, low-profile, diversity, dual-band, circular-polarization, and reconfiguration applications. On the other hand, for unilateral radiation, structures with cavity-backed slot-monopole configurations have been used.

In some applications, lateral radiation may be more preferred than the broadside radiation. For example, for a household wireless router that is arranged to be placed against a wall, a unilateral radiation pattern is more preferred because back radiation inside the wall, if any, would go wasted. Problematically, however, existing structures for unilateral radiation require the use of cavities and relatively large ground planes, and hence are rather bulky.

There is a need for a unidirectional antenna, in particular one that generates unilateral radiation pattern, that is compact, easy to manufacture, and operationally efficient, to be adapted for use in modern wireless communication systems.

SUMMARY OF THE INVENTION

In accordance with a first aspect of the invention, there is provided a dielectric resonator antenna comprising: a dielectric substrate with a ground plane; a dielectric resonator element arranged on the ground plane; a conductive feeding assembly operable to excite one or more dielectric resonator modes of the dielectric resonator element for generation of a first circularly polarized electromagnetic field; and a radiating arrangement operable to produce a second circularly polarized electromagnetic field complementary to the first circularly polarized electromagnetic field; wherein the first and second circularly polarized electromagnetic fields, when combined, are arranged to provide a unilateral circularly polarized electromagnetic field.

Preferably, the feeding assembly is operable to excite, at least, a first dielectric resonator mode of the dielectric resonator element and a second dielectric resonator mode of the dielectric resonator element.

Preferably, the first dielectric resonator mode is $TE_{01\delta+1}$ mode; the second dielectric resonator mode is $TM_{01\delta}$ mode.

Preferably, the feeding assembly comprises: a feeding network arranged to excite a first dielectric resonator mode of the dielectric resonator element; and a feeding probe arranged to excite a second dielectric resonator mode of the dielectric resonator element.

Preferably, the feeding assembly further comprises: a micro-strip feed line arranged to be connected with the feeding probe.

Preferably, the feeding network is arranged on one side of the dielectric substrate with the ground plane, and the micro-strip feed line is arranged on an opposite side of the dielectric substrate.

Preferably, the feeding network comprises an antenna.

Preferably, the antenna is substantially planar.

Preferably, the antenna comprises: a central conductive portion; a plurality of conductive stub portions extending radially from the central conductive portion; and a plurality of conductive arc portions each extending circumferentially from a respective conductive stub portion. The number of are portions corresponds to the number of stub portions.

In one example, the antenna comprises four conductive stub portions that are angularly spaced apart from each other. The conductive stub portions are preferably equally spaced apart.

Preferably, the feeding probe comprises any of: a cylindrical probe, a conical probe, an inverted conical probe, stepped cylindrical probe, and a planar micro-strip folded monopole.

Preferably, the feeding probe is at least partly arranged in a chamber defined in the dielectric resonator element. The feeding probe may extend through the substrate to connect with the micro-strip line.

Preferably, the chamber defines a cylindrical space and the feeding probe has a cylindrical body. The cylindrical space and the cylindrical body may be co-axial.

Preferably, the radiating arrangement comprises a slot antenna. Optionally, the radiating arrangement may be a patch or a dielectric resonator element.

Preferably, the feeding network comprises an antenna having: a central conductive portion; a plurality of conductive stub portions extending radially from the central conductive portion; and a plurality of conductive arc portions each extending circumferentially from a respective conductive stub portion; and wherein the slot antenna comprises a slot formed by or within the central conductive portion.

Preferably, the slot is cross-shaped. The two perpendicular slot portions of the cross are preferably of different length.

Preferably, the dielectric resonator element comprises a body that is cylindrical. An opening, e.g., through-hole, may be provided in the body for receiving the feeding probe.

Preferably, the dielectric resonator antenna is particularly updated for WLAN applications.

Preferably, a ratio of a footprint of the ground plane to a footprint of the dielectric resonator element is between 1 to 1.2.

In accordance with a second aspect of the invention, there is provided dielectric resonator antenna comprising: a dielectric resonator element; a conductive feeding assembly operable to excite one or more dielectric resonator modes of the dielectric resonator element for generation of a first circularly polarized electromagnetic field; and a radiating arrangement operable to produce a second circularly polarized electromagnetic field complementary to the first circularly polarized electromagnetic field; wherein the first and second circularly polarized electromagnetic fields, when combined, are arranged to provide a unilateral circularly polarized electromagnetic field.

In accordance with a third aspect of the invention, there is provided a dielectric resonator antenna array comprising one or more the dielectric resonator antenna of the first aspect.

In accordance with a fourth aspect of the invention, there is provided wireless communication system comprising one or more the dielectric resonator antenna of the first aspect.

BRIEF DESCRIPTION OF THE DRAWINGS

Embodiments of the invention will now be described, by way of example, with reference to the accompanying drawings in which:

FIG. 16 shows idealized radiation patterns of dielectric resonator antenna-A, dielectric resonator antenna-B, and unilateral dielectric resonator antenna.

DETAILED DESCRIPTION OF THE PREFERRED EMBODIMENT

Figure 1A:
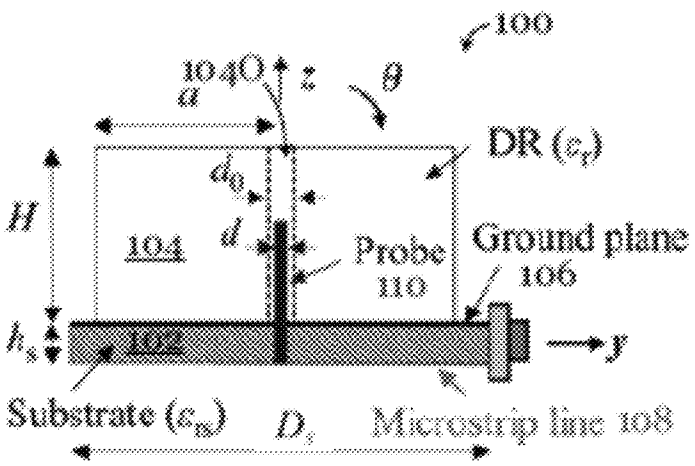
FIG. 1A is a side view of a dielectric resonator antenna in accordance with one embodiment of the invention.
Figure 1B:
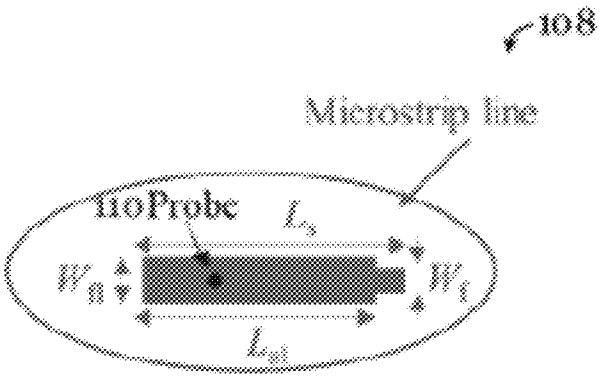
FIG. 1B is a plan view of a micro-strip feed line on the substrate of the dielectric resonator antenna of FIG. 1A.
Figure 1C:
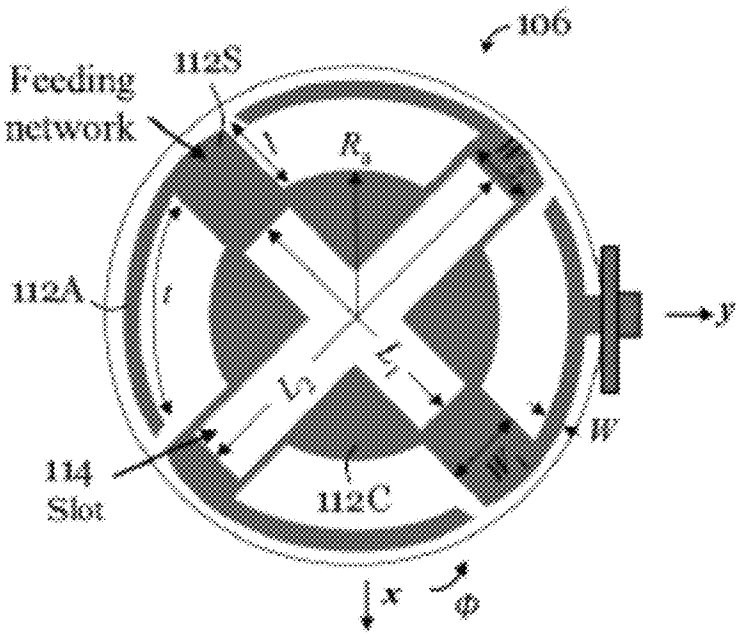
FIG. 1C is a plan view of a feeding network arranged on the ground plane of the dielectric resonator antenna of FIG. 1A.

FIGS. 1A to 1C illustrate a dielectric resonator antenna 100 in one embodiment of the invention. The dielectric resonator antenna 100 is a circularly polarized unilateral dielectric resonator antenna arranged to provide unilateral circularly polarized radiation. The antenna 100 includes a dielectric substrate 102 with a ground plane 106 on one side, and a dielectric resonator element 104 arranged on the ground plane 106. In the present embodiment, the dielectric resonator element 104 includes a cylindrical body with a through-opening 1400 formed in the body. The through-opening 1400 may be generally cylindrical, and has a diameter $d_o$. The cylindrical dielectric resonator element 104 has a dielectric constant $\varepsilon_r$, radius a, and height H. The dielectric substrate 102 with ground plane 106 is also cylindrical, with a generally circular cross section. The substrate 102 has a dielectric constant of $\varepsilon_{rs}$, thickness of $h_s$, and diameter of $D_s$, as illustrated in FIG. 1A. Preferably, a ratio of a footprint of the ground plane 106 to a footprint of the dielectric resonator element 104 is between 1 to 1.2.

The antenna 100 also includes a conductive feeding assembly operable to one or more dielectric resonator modes of the dielectric resonator element 104 for generation of a first circularly polarized electromagnetic field and a radiating arrangement 114 operable to produce a second circularly polarized electromagnetic field complementary to the first circularly polarized electromagnetic field. The first and second circularly polarized electromagnetic fields, when combined, are arranged to provide a unilateral circularly polarized electromagnetic field. In the present embodiment, two sets of circularly polarized fields are realized in a single dielectric resonator element 104 that is arranged to act as an antenna or part of an antenna.

In one embodiment, the conductive feeding assembly includes a feeding network 112 arranged to excite a first dielectric resonator mode of the dielectric resonator element 104; a feeding probe 110 arranged to excite a second dielectric resonator mode of the dielectric resonator element 104; and a micro-strip feed line 108 arranged to be connected with the feeding probe 110. The first and second dielectric resonator modes may be $TE_{01\delta+1}$ mode and $TM_{01\delta}$ mode respectively.

In the present embodiment, the feeding network 112 is arranged on the side of the dielectric substrate 102 with the ground plane 106. The feeding network 112 includes an antenna that is substantially planar and is in a modified Alford loop configuration. As shown in FIG. 1C, the antenna comprises a central conductive portion 112C, four generally equally angularly spaced conductive stub portions 112S extending radially from the central conductive portion, and four conductive arc portions 112A each extending circumferentially from a respective conductive stub portion. The central conductive portion 112C has a generally cylindrical contour of radius $R_a$. The shape and form of the first diametrically opposed stub portions 112S are generally the same, with a width $W_1$ (extending perpendicular to the radial direction). The shape and form of the second diametrically opposed stub portions are generally the same, but they are different to those of the first diametrically opposed stub portions. The radial extension of the first diametrically opposed stub portions has a length l. Each are portion 112A extends circumferentially in an anti-clockwise manner, towards and without touching an adjacent stub portion 112S. Each are portion 112A includes a width W (extending radially) and a circumferential spanning angle t. Preferably, the number of stub portions 112S and the number of arc portions 112A are preferably the same, but they could be more than or less than four. The feeding network 112 may be used to excite the $TE_{01\delta+1}$ mode of the dielectric resonator element 104.

The feeding probe 110 is a cylindrical probe that is arranged in the through-opening 1400 of the dielectric resonator element 104. The feeding probe 110 also penetrates the substrate 102 to connect with the micro-strip feed line 108 arranged on the side of the substrate 102 opposite the ground plane 106. The probe 110 has a diameter d and length h. Preferably, the probe 110 is soldered onto the micro-strip feed line 108. The probe 110 may be used to excite a $TM_{01\delta}$ mode of the dielectric resonator element 104.

In the present embodiment, the radiating arrangement 114 comprises a slot antenna formed by or within the central conductive portion 112C. The slot antenna includes a cross-shaped slot, with two perpendicular, crossed slot portions of different lengths. As shown in FIG. 1C, the shorter slot portion with length $L_1$ and width $W_2$ extends between the stub portions with width $W_1$, and the longer slot portion with length $L_2$ (larger than $L_1$) and width $W_2$ extends substantially perpendicular to the shorter slot portion.

As shown in FIG. 1B, the micro-strip feed line 108 printed on the other side of the substrate 102. The micro-strip feed line 108 includes a large rectangular portion with a length $L_{s1}$ and a width $W_{f1}$ and a small rectangular portion with width $W_f$. The length of the entire micro-strip feed line 108 is $L_s$.

In one example, the dielectric resonator element 104 has a dielectric constant $\varepsilon_r$ of 10 (with the loss tangent lower than 0.002), a radius a of 23.1 mm, and a height H of 20.9 mm. The substrate 102 has a dielectric constant $\varepsilon_{rs}$ of 2.33, thickness $h_s$ of 1.57 mm, and diameter $D_s$ of 53 mm. The feeding network 112/ground plane 106 has a radius $R_a$ of 15.5 mm, a length l of 8.7 mm, a width $W_1$ of 9 mm, a width W of 2 mm, and a circumferential spanning angle t of 89°. The cross-shaped slot 114 has a length $L_1$ of 25.6 mm, a length $L_2$ of 41.6 mm, and a width $W_2$ of 6.8 mm. The micro-strip feed line 108 has a length $L_s$ of 34 mm, a length $L_{s1}$ of 30 mm, a width $W_f$ of 4.6 mm, and a width $W_{f1}$ of 9 mm. The through-opening 1400 in the body of the dielectric resonator element 104 has a diameter $d_o$ of 2 mm. The probe 110 has a diameter d of 1.5 mm and a length h of 10.6 mm.

Figure 2B:
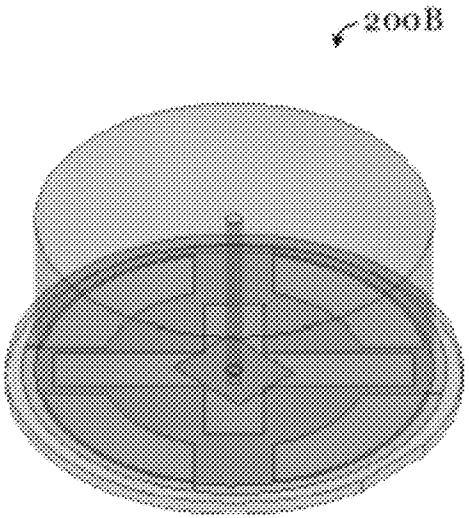
FIG. 2B is a schematic of a second antenna arrangement (dielectric resonator antenna-B) of the dielectric resonator antenna of FIG. 1A.
Figure 2A:
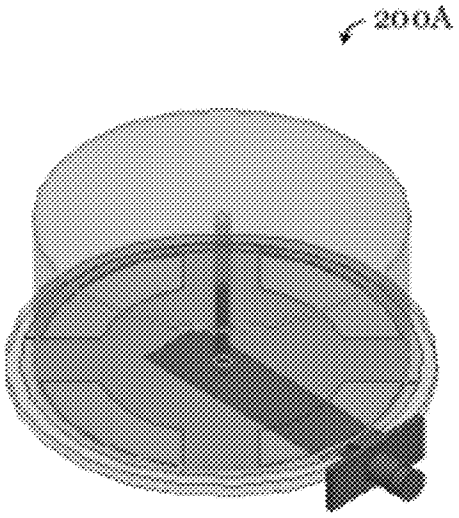
FIG. 2A is a schematic of a first antenna arrangement (dielectric resonator antenna-A) of the dielectric resonator antenna of FIG. 1A.

To illustrate the operation principle of the antenna in FIG. 1A, the dielectric resonator antenna 100 in FIG. 1A is divided into two antenna arrangements, namely dielectric resonator antenna-A 200A as shown in FIG. 2A and dielectric resonator antenna-B 200B as shown in FIG. 2B. The parameters in dielectric resonator antenna-A 200A and dielectric resonator antenna-B 200B are the same as that illustrated above with respect to FIGS. 1A to 1C.

Dielectric resonator antenna-A 200A is modified from an omnidirectional circularly polarized dielectric resonator antenna design presented in W. W. Li and K. W. Leung, "*Omnidirectional Circularly Polarized Dielectric Resonator Antenna With Top-Loaded Alford Loop for Pattern Diversity Design,*" *IEEE Trans Antennas Propag.*, vol. 61, no. 8, pp. 4246-4256, August 2013, with the Alford arrangement moved from the top of the dielectric resonator element to the bottom of the dielectric resonator element. It is observed that the simulated reflection coefficient of dielectric resonator antenna-A has two resonant dielectric resonator modes at 2.34 GHz and 2.49 GHz.

Figure 3B:
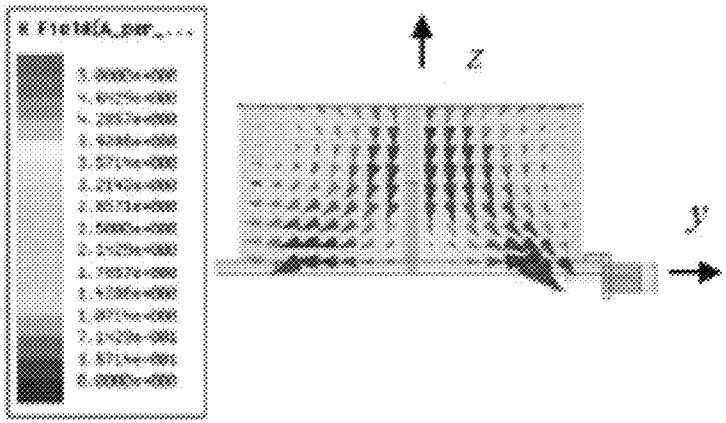
FIG. 3B is a plot showing a simulated H-field in the first antenna arrangement of FIG. 2A in elevation (y-z) plane at x=0 and at 2.34 GHz.
Figure 3A:
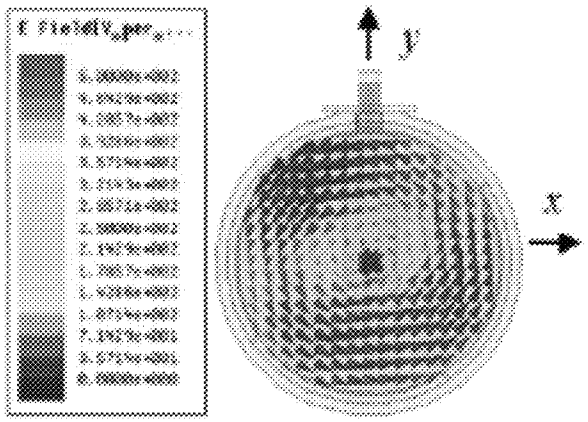
FIG. 3A is a plot showing a simulated E-field in the first antenna arrangement of FIG. 2A in azimuthal (x-y) plane at z=H/2 and at 2.34 GHz.

FIGS. 3A and 3B show the simulated E-field in the antenna arrangement of FIG. 2A in azimuthal (x-y) plane at z=H/2 and H-field in the antenna arrangement of FIG. 2A in elevation (y-z) plane at x=0, at 2.34 GHz, the first resonant mode. As shown in FIGS. 3A and 3B, a dielectric resonator $TE_{01\delta+1}$ mode that radiates like a pair of equivalent z-directed magnetic dipoles is generated. The inference of the mode can be verified by its resonant frequency (2.34 GHz), which is close to that calculated using a $TE_{01\delta+1}$ mode frequency formula (2.37 GHz).

Figure 3D:
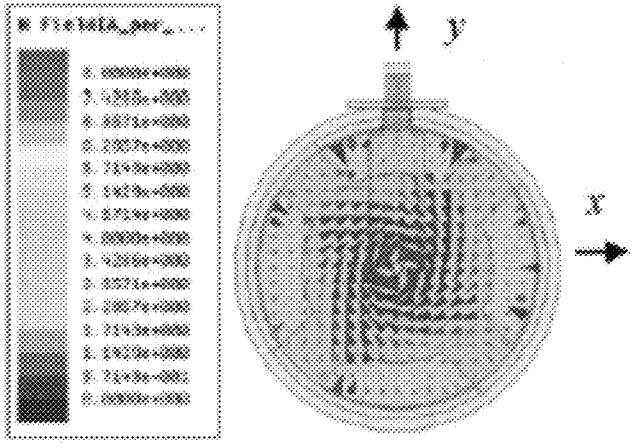
FIG. 3D is a plot showing a simulated H-field in the first antenna arrangement of FIG. 2A in azimuthal (x-y) plane at z=0 at 2.49 GHz.
Figure 3C:
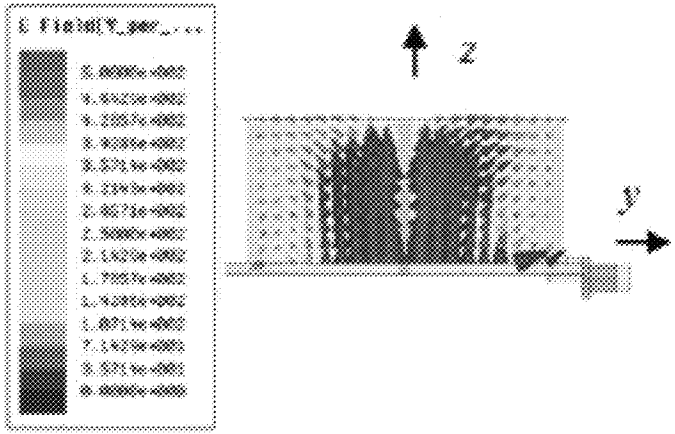
FIG. 3C is a plot showing a simulated E-field in the first antenna arrangement of FIG. 2A in elevation (y-z) plane at x=0 at 2.49 GHz.

FIGS. 3C and 3D show the simulated E-field in the antenna arrangement of FIG. 2A in elevation (y-z) plane at x=0 and H-field in the antenna arrangement of FIG. 2A in azimuthal (x-y) plane at z=0, at 2.49 GHz, the second resonant mode. As shown in FIGS. 3C and 3D, the field distribution corresponds to dielectric resonator $TM_{01\delta}$ mode that radiates like a z-directed electric dipole. The $TM_{01\delta}$ mode frequency as calculated using the formula is 2.42 GHz, which is close to the simulated resonant frequency (2.49 GHz).

Figures 4A, 4B:
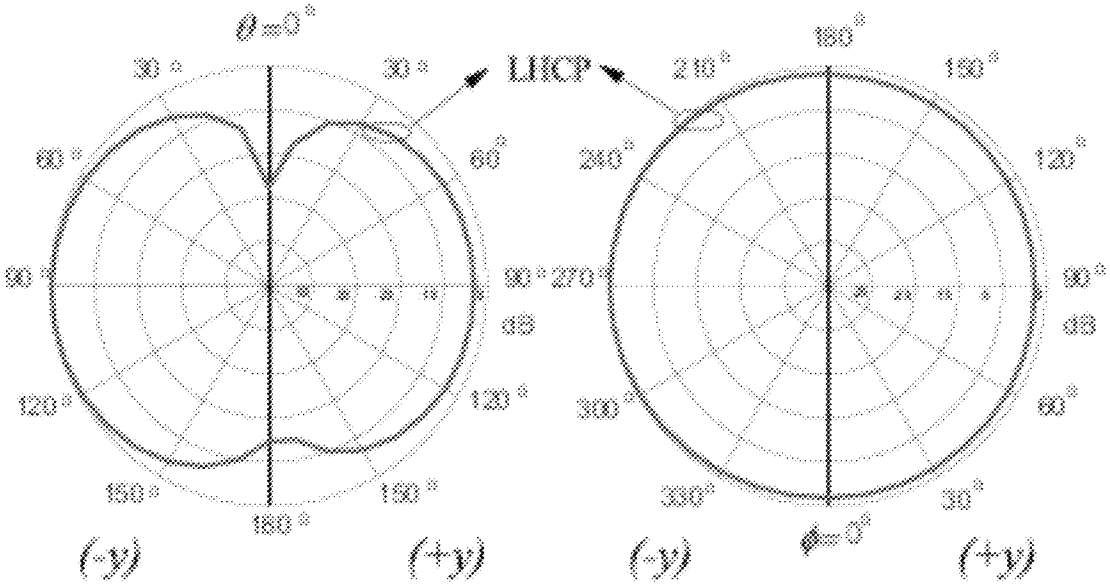
FIG. 4A is a plot showing a simulated co-polarized pattern of the first antenna arrangement of FIG. 2A in elevation (y-z) plane at 2.44 GHz.
FIG. 4B is a plot showing a simulated co-polarized pattern of the first antenna arrangement of FIG. 2A in azimuthal (x-y) plane at 2.44 GHz.

FIGS. 4A and 4B respectively show the simulated co-polarized pattern (normalized) of the first antenna arrangement of FIG. 2A in elevation (y-z) plane and in azimuthal (x-y) plane at 2.44 GHz, the center frequency of the frequency band (2.4-2.48 GHz). As expected, patterns "∞" and "O" were observed in the yz- and xy-planes, respectively, with the asymmetry caused by the feed line. The theoretical (ideal) version of the corresponding circularly polarized field pattern is given in Table I under the column of "Dielectric Resonator Antenna-A Patterns".

Dielectric resonator antenna-B 200B is a circularly polarized dielectric resonator-loaded slot antenna.

Figures 5A, 5B:
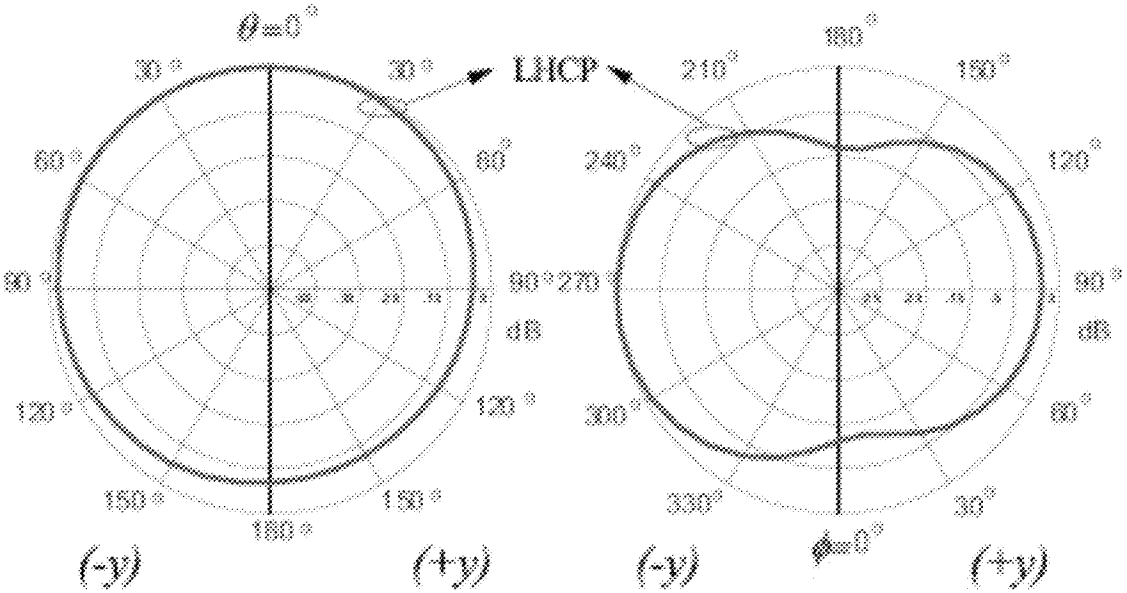
FIG. 5A is a plot showing a simulated co-polar pattern of the second antenna arrangement of FIG. 2B in elevation (y-z) plane at 2.44 GHz.
FIG. 5B is a plot showing a simulated co-polar pattern of the second antenna arrangement of FIG. 2B in azimuthal (x-y) plane at 2.44 GHz.

FIGS. 5A and 5B respectively show the simulated co-polarized pattern (normalized) of the second antenna arrangement of FIG. 2B in elevation (y-z) plane and in azimuthal (x-y) plane at 2.44 GHz, the center frequency of the frequency band (2.4-2.48 GHz). As shown in FIGS. 5A and 5B, patterns "O" and "∞" were observed in the yz- and xy-planes, respectively. The theoretical (ideal) version of the corresponding circularly polarized field pattern is given in Table I under the column of "Dielectric Resonator Antenna-B Patterns".

By combining the two sets of idealized circularly polarized field patterns illustrated in FIGS. 4A to 5B, a unilateral circularly polarized field pattern can be obtained (due to constructive and destructive interferences in the −y and +y directions, respectively). The resultant unilateral circularly polarized field patterns are shown in the last column ("Unilateral Patterns") of FIG. 16.

Figure 6B:
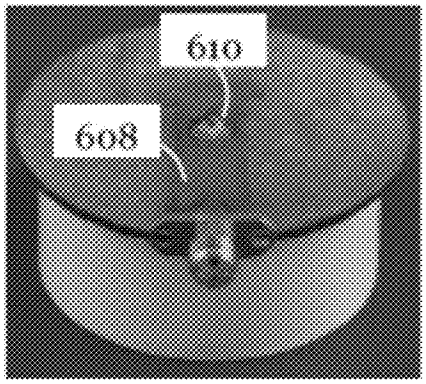
FIG. 6B is a photo showing a dielectric resonator antenna (assembled) in one embodiment of the invention.
Figure 6A:
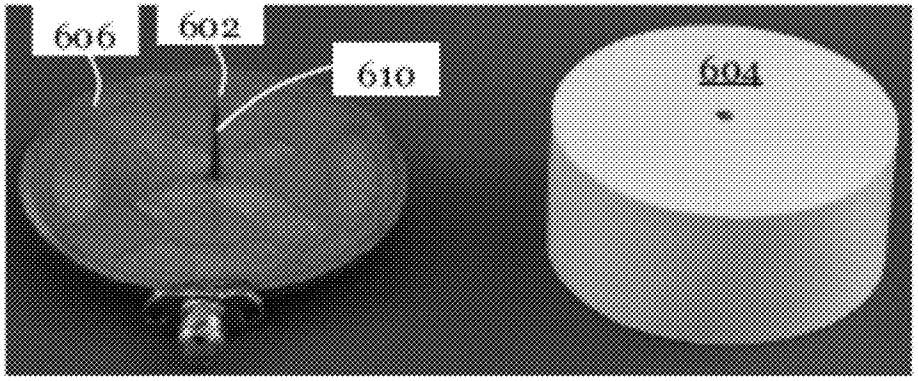
FIG. 6A is a photo showing a dielectric resonator antenna (disassembled) in one embodiment of the invention.

FIGS. 6A and 6B shows a prototype of the circularly polarized unilateral dielectric resonator antenna 600 at 2.4 GHz WLAN band in one embodiment of the invention, fabricated based on the antenna 100 construction illustrated in FIGS. 1A to 1C. In particular, FIG. 6A shows the antenna 600 in disassembled state, illustrating the dielectric resonator element 604 and the ground plane 606 on the substrate 602. FIG. 6B shows the antenna 600 in the assembled state, illustrating the micro-strip feed line 608 with a probe 610 soldered thereto. In this example, the antenna 600 was designed by ANSYS HFSS and fabricated by using an ECCOSTOCK HiK dielectric material with $\varepsilon_r$=10 and tan $\delta$<0.002. In this example, the optimized parameters are H=20.9 mm, a=23.1 mm, $\varepsilon_r$=10, $h_s$=1.57 mm, $\varepsilon_{rs}$=2.33, $D_s$=53 mm, $R_a$=15.5 mm, 1=8.7 mm, $W_1$=9 mm, W=2 mm, t=890, $L_1$=25.6 mm, $L_2$=41.6 mm, $W_2$=6.8 mm, $L_s$=34 mm, $L_{s1}$=30 mm, $W_f$=4.6 mm, $W_f$=9 mm, $d_o$=2 mm, d=1.5 mm, and h=10.6 mm.

Simulations and experiments were conducted to evaluate the performance of the antenna 600. In the experiment, the reflection coefficient was measured to using an HP8510C network analyzer, whereas the radiation pattern, antenna gain, and antenna efficiency were measured using a Satimo Starlab System. A balun was added to the coaxial cable to suppress stray radiation from the coaxial cable. To prevent the current from flowing on the outer conductor of the coaxial cable, an RF choke was deployed in the measurement.

Figure 7:
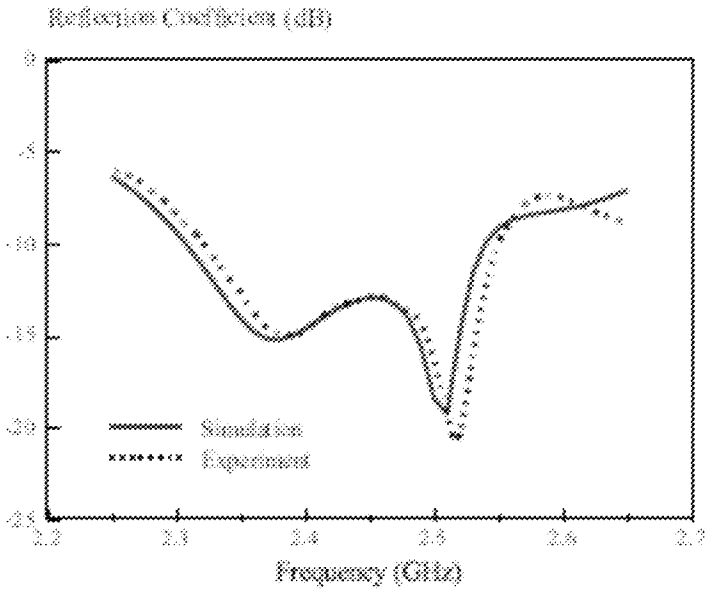
FIG. 7 is a plot showing simulated and measured reflection coefficients (dB) of the dielectric resonator antenna of FIGS. 6A and 6B (same parameters as the one of FIG. 1) for different frequencies (GHz)

FIG. 7 shows the simulated and measured reflection coefficients of the circularly polarized unilateral dielectric resonator antenna. As shown in FIG. 7, there is reasonable agreement between the simulation and the measurement obtained in the experiment. The simulated and measured minimum reflection coefficients are found at 2.51 GHz and 2.52 GHz, respectively, with a small error of 0.4%. The simulated and measured impedance bandwidths ($|S_{11}|$−10 dB) are 9.48% (2.31-2.54 GHz) and 9.43% (2.32-2.55 GHz), respectively.

Figure 8:
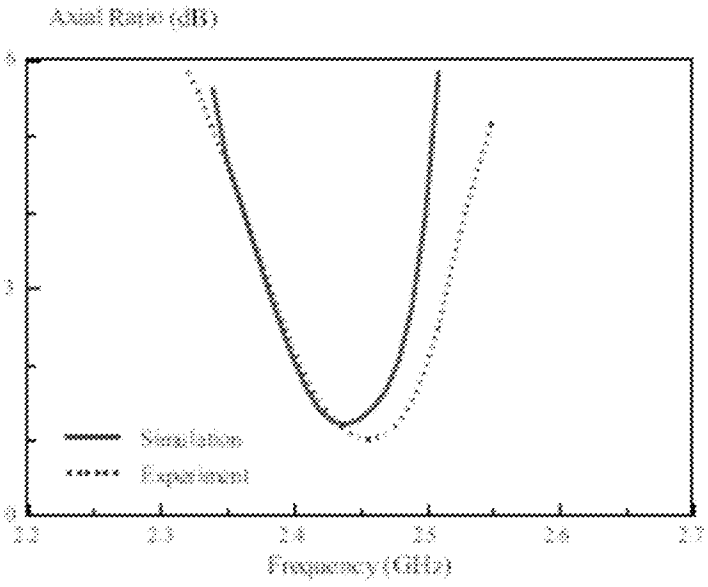
FIG. 8 is a plot showing simulated and measured axial ratio (dB) of the dielectric resonator antenna of FIGS. 6A and 6B (same parameters as the one of FIG. 1) for different frequencies (GHz)

FIG. 8 shows the simulated and measured axial ratios in the lateral direction ($\theta$=90°, $\phi$=270°). As shown in FIG. 8, the simulated and measured minimum axial ratios are 1.2 dB and 1.0 dB at 2.44 GHz and 2.46 GHz, respectively. For the 3-dB axial ratio bandwidths, the simulated and measured results are 4.1% (2.39-2.49 GHz) and 4.9% (2.39-2.51 GHz), respectively. Both results cover the entire 2.4-GHz WLAN band (2.4-2.48 GHz). Apparently, the operating bandwidth of the antenna is limited by the axial ratio bandwidth.

Figures 9A, 9B:
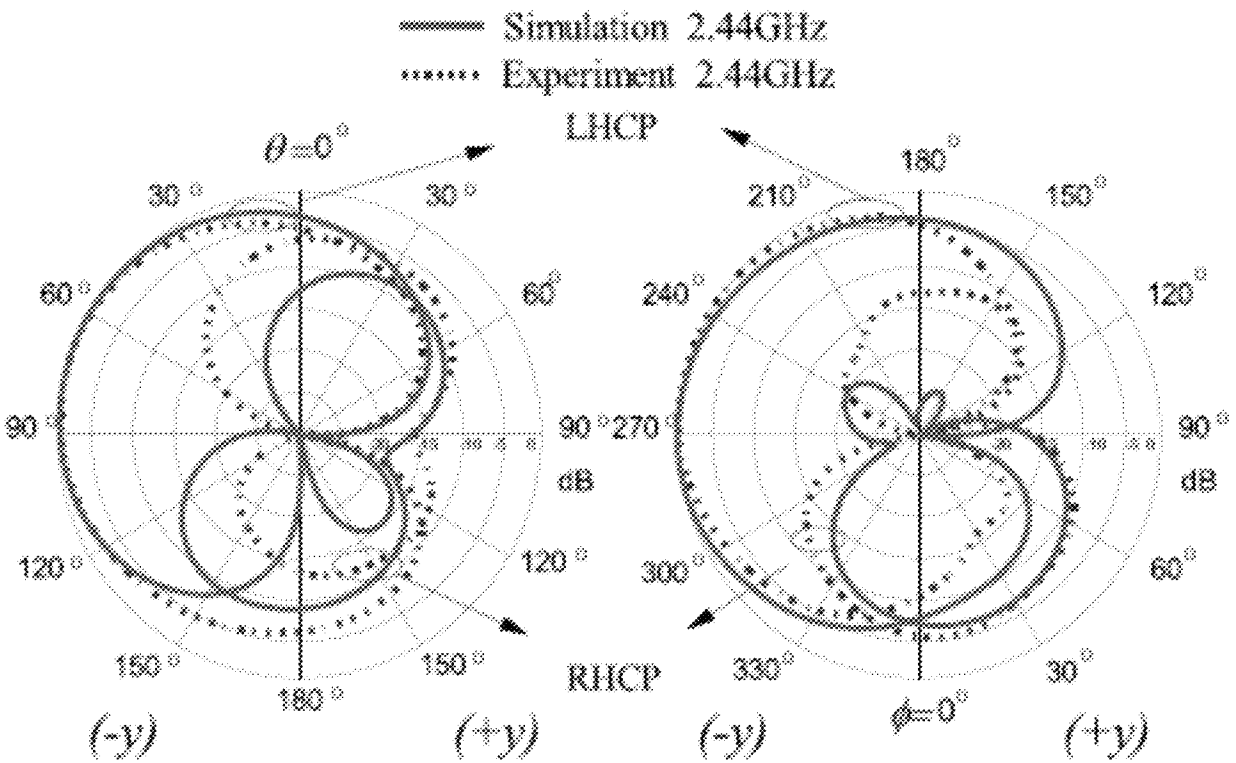
FIG. 9A is a plot showing simulated and measured radiation patterns in elevation (y-z) plane for the dielectric resonator antenna of FIGS. 6A and 6B (same parameters as the one of FIG. 1)
FIG. 9B is a plot showing simulated and measured radiation patterns in azimuthal (x-y) plane for the dielectric resonator antenna of FIGS. 6A and 6B (same parameters as the one of FIG. 1)

FIGS. 9A and 9B respectively show the simulated and measured radiation patterns in the elevation (y-z) and azimuthal (x-y) planes at 2.44 GHz. As shown in FIGS. 9A and 9B, a −y-directed unidirectional circularly polarized radiation pattern is obtained, with reasonable agreement between the simulation and measurement. In the lateral direction ($\theta$=90°, $\phi$=270°), the measured left-hand circularly polarized field is stronger than the right-hand circularly polarized field by 35.7 dB. With reference to the left-hand circularly polarized field, the simulated and measured front-to-back ratios are 23.1 dB and 26.7 dB, respectively. The actual front-to-back ratio of the antenna, however, is limited by the backlobe of the right-hand circularly polarized field. When the right-hand circularly polarized field is also considered, the simulated and measured front-to-back ratios are reduced to 16.1 dB and 15.5 dB, respectively. It can be found from the figure that the measured 3-dB beamwidths in the yz- and xy-planes are given by 123° and 120°, respectively, whereas the simulated beamwidth is 131° for both planes.

Table I gives the simulated and measured front-to-back ratios at 2.40 GHz, 2.44 GH, and 2.48 GHz. With reference to the table, the simulated and measured front-to-back ratios are at least 15 dB and 13.9 dB, respectively.

TABLE I

Simulated and Measured Front-To-Back Ratios of Unilateral Circularly Polarized Dielectric Resonator Antenna in 2.4 GHz WLAN Band

| Frequency (GHz) | Simulated front-to-back ratio (dB) | Measured front-to-back ratio (dB) |
|---|---|---|
| 2.40 | 15.0 | 13.9 |
| 2.44 | 16.1 | 15.5 |
| 2.48 | 16.9 | 17.6 |

Figure 10:
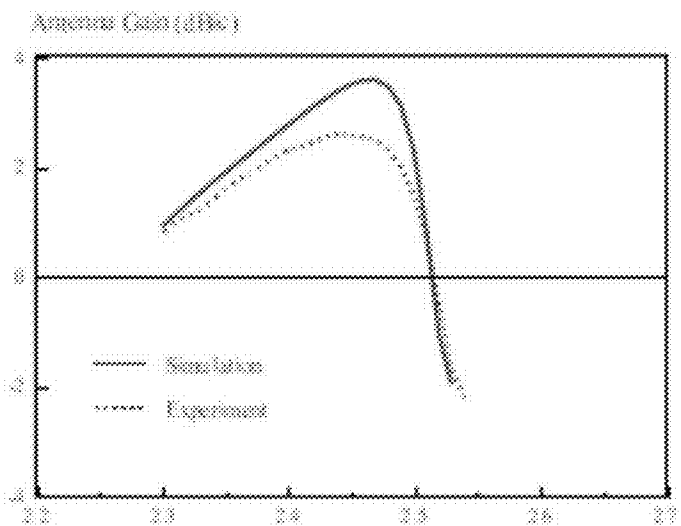
FIG. 10 is a plot showing simulated and measured antenna gains in the lateral direction ($\theta$=90°, $\phi$=270°) for the dielectric resonator antenna of FIGS. 6A and 6B (same parameters as the one of FIG. 1)

FIG. 10 shows the simulated and measured antenna gains in the lateral direction (−y-direction) as a function of frequency. As shown in FIG. 10, the simulation and measurement are in reasonable agreement. The simulated and measured peak gains are 3.57 dBic and 2.58 dBic, respectively. The difference between the measured gain and the simulated gain is likely due to experimental imperfections.

Figure 11:
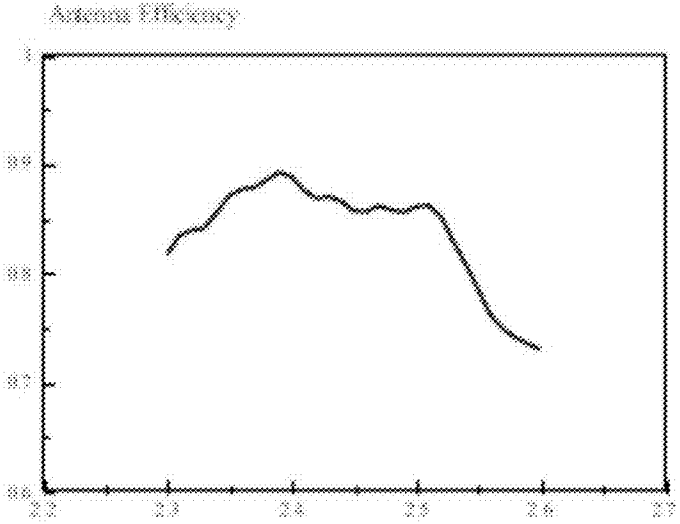
FIG. 11 is a plot showing measured antenna efficiency of the dielectric resonator antenna of FIGS. 6A and 6B (same parameters as the one of FIG. 1) for different frequencies (GHz)

FIG. 11 shows the measured antenna efficiency that has included impedance mismatch. The efficiency varies between 85.6% and 89.2% across the operating bandwidth (2.39-2.51 GHz).

Figure 12A:
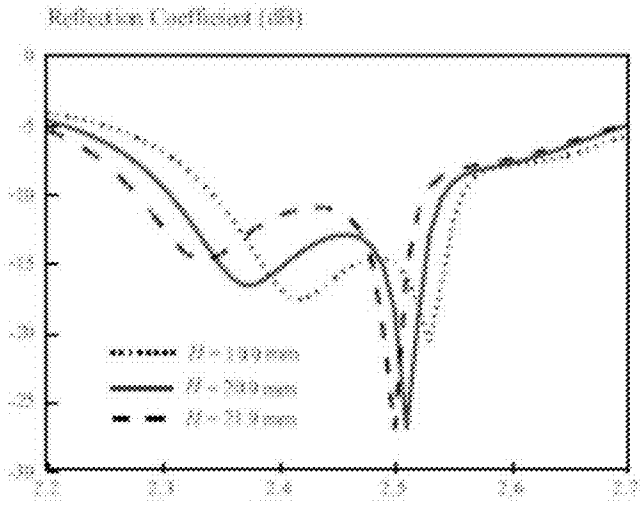
FIG. 12A is a plot showing simulated reflection coefficient (dB) of dielectric resonator antennas of FIG. 1 with different heights H (H=19.9 mm, 20.9 mm, and 21.9 mm) (other parameters are the same) for different frequencies (GHz)
Figure 12B:
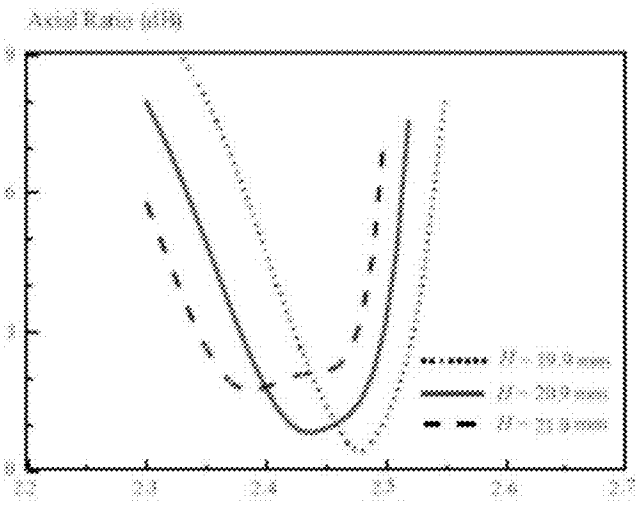
FIG. 12B is a plot showing simulated axial ratio (dB) of dielectric resonator antennas of FIG. 1 with different heights H (19.9 mm, 20.9 mm, and 21.9 mm) (other parameters are the same) for different frequencies (GHz)

A parametric study was carried out to determine the critical parameters of the antenna. To begin with, the dielectric resonator height H is varied and its effects on the reflection coefficient and axial ratio are given in FIGS. 12A and 12B. As shown, H shifts the frequencies of the impedance curve (FIG. 12A) and axial ratio curve (FIG. 12B). This indicates that the size of the dielectric resonator element has strong effects on the antenna frequency. The effect of dielectric resonator radius a was also studied and similar results were observed.

Figure 13B:
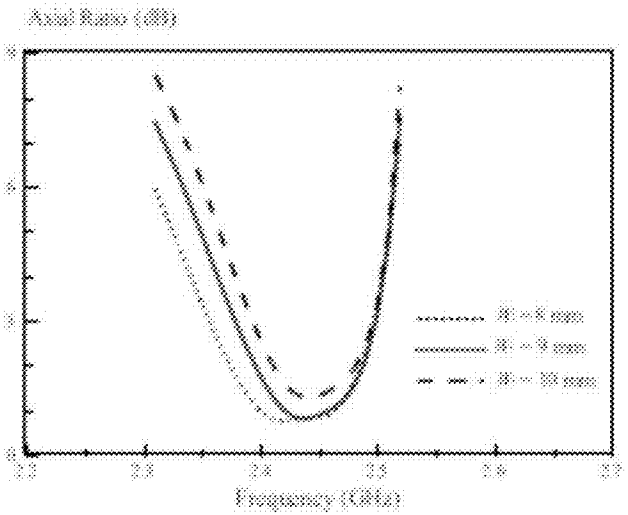
FIG. 13B is a plot showing simulated axial ratio (dB) of dielectric resonator antennas of FIG. 1 with different stub portion widths $W_1$ (8 mm, 9 mm, and 10 mm) (other parameters are the same) for different frequencies (GHz)
Figure 13A:
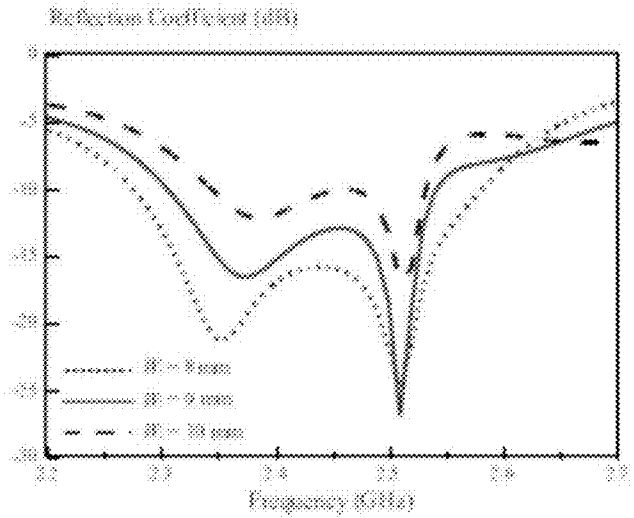
FIG. 13A is a plot showing simulated reflection coefficient (dB) of dielectric resonator antennas of FIG. 1 with different stub portion widths $W_1$ (8 mm, 9 mm, and 10 mm) (other parameters are the same) for different frequencies (GHz)

Next, the extended stub width $W_1$ is studied. FIGS. 13A and 13B show the reflection coefficients (FIG. 13A) and axial ratios (FIG. 13B) for different $W_1$. As shown, $W_1$ can be used to tune the impedance match and axial ratio bandwidth. It should be mentioned that although using $W_1$=8 mm gives better impedance and axial ratio bandwidth, the corresponding front-to-back ratio is degraded. As a result, $W_1$=9 mm is used in the design of the present example as a compromise between the impedance match, axial ratio bandwidth, and front-to-back ratio. Similar results were obtained when changing the parameter W.

Figure 14B:
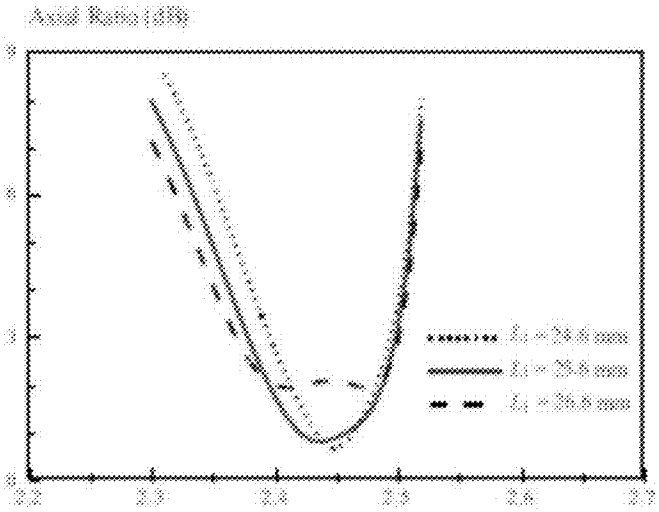
FIG. 14B is a plot showing simulated axial ratio (dB) of dielectric resonator antennas of FIG. 1 with different slot lengths $L_1$ (24.6 mm, 25.6 mm, and 26.6 mm) (other parameters are the same) for different frequencies (GHz)
Figure 14A:
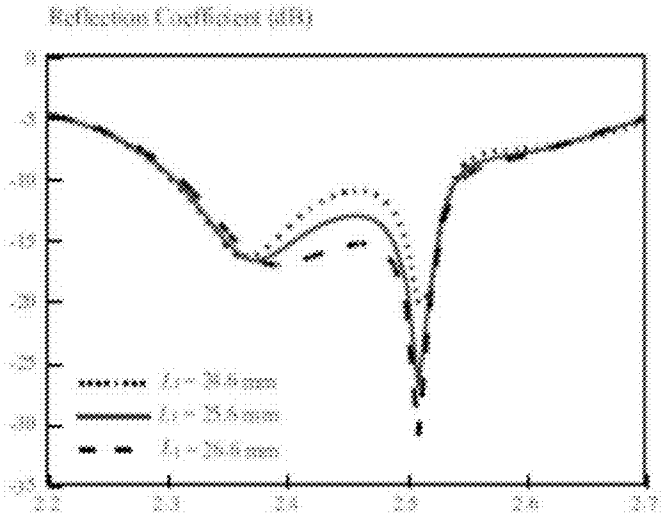
FIG. 14A is a plot showing simulated reflection coefficient (dB) of dielectric resonator antennas of FIG. 1 with different slot lengths $L_1$ (24.6 mm, 25.6 mm, and 26.6 mm) (other parameters are the same) for different frequencies (GHz)

Finally, the effect of the cross slot is studied. For brevity, only $L_1$ is discussed here. FIGS. 14A and 14B show the effects of $L_1$ on the reflection coefficient (FIG. 14A) and axial ratio (FIG. 14B). As shown, $L_1$ can be used to tune both the impedance matching and axial ratio bandwidth. Also, increasing $L_1$ improves impedance match (FIG. 14A) but degrades the axial ratio level (FIG. 14B). As a compromise, $L_1$ of 25.6 mm was used in the design of the present example.

Figure 15:
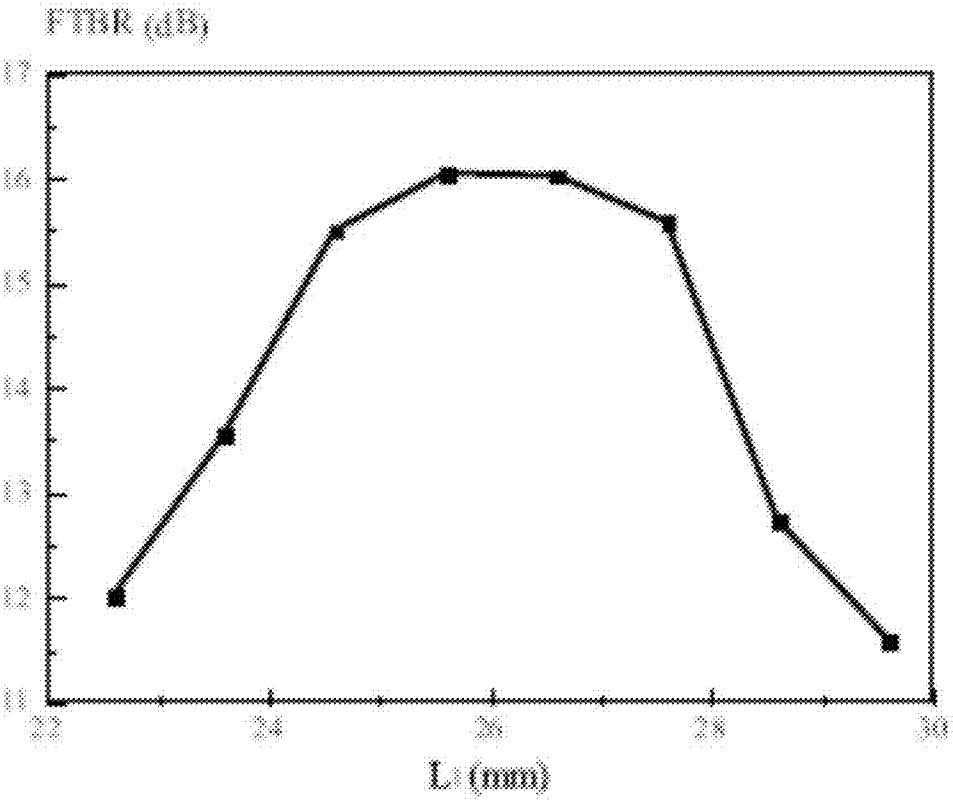
FIG. 15 is a plot showing simulated front-to-back ratio of the dielectric resonator antennas of FIG. 1 for different slot length $L_1$ (other parameters are the same).

FIG. 15 shows the simulated front-to-back ratio as function of $L_1$. As shown, the best front-to-back ratio is found at around $L_1$=25.6 mm, which is not surprising because axial ratio is optimum at around this $L_1$.

Based on the parametric study, a design guideline for the antenna in one embodiment of the invention can be devised as follows. First, the dielectric resonator dimensions are determined to obtain the required dielectric resonator radiating modes and frequency band. Next, the ground-plane parameters ($W_1$, W) are adjusted to obtain good impedance and axial ratio levels. Finally, the slot dimensions ($L_1$, $L_2$) are tuned to optimize the impedance match and axial ratio so as to obtain the optimum front-to-back ratio.

The above embodiments of the invention provide a circularly polarized unilateral dielectric resonator antenna. In one embodiment, the radius of the ground plane is only $0.19\lambda_0$ and the two required circularly polarized field sets are obtained through a single dielectric resonator element. These provide an antenna with a compact design that is particularly suited for modern wireless communication systems. Advantageously, the unilateral antenna in the present invention can generate radiation in the desired lateral direction, reducing wasted power in unwanted direction. The uni-directionality can also provide better receiving sensitivity and suppress the interference with other devices. Therefore, unilateral antennas in the present invention are desirable for certain applications when the antenna needs to be located on or beside another object such as a wall or communication tower. Besides, the circular polarization can mitigate multipath interference and relax the alignment between the transmitting and receiving antennas. This makes the unilateral circularly polarized antenna is desirable in modern wireless system. By using dielectric materials for the unilateral circularly polarized dielectric resonator antenna, the antenna can have very low-loss even at mm-wave frequencies, resulting in high radiation efficiency. Different bandwidths for different applications can be obtained, by selecting suitable dielectric constant to be used in the unilateral dielectric resonator antenna of the present invention.

It will be appreciated by persons skilled in the art that numerous variations and/or modifications may be made to the invention as shown in the specific embodiments without departing from the spirit or scope of the invention as broadly described. For example, the feeding network is not limited to the illustrated modified Alford loop arrangement (circular patch with four stubs), but can be of any other shapes and form, and can be arranged at a different location. The feeding probe can be of any shape, such as a cylindrical probe, a cone probe, an inverted cone probe, a stepped cylindrical probe, and planar microstrip folded monopoles. Modes other than $TM_{01\delta}$ mode and $TE_{01\delta+1}$ mode can be used to achieve the first circularly polarized set. The second circularly polarized field can be obtained using a different type of radiating element, such as a patch, a dielectric resonator (i.e., not necessarily a slot antenna). The permittivity $\varepsilon_r$ of the dielectric resonator element can be varied depending on applications. The dielectric resonator element can be of other shape, not necessarily cylindrical. Likewise, the ground plane can be of any shape, not necessarily circular. The present embodiments are, therefore, to be considered in all respects as illustrative and not restrictive.

The invention claimed is:

1. A dielectric resonator antenna comprising:
- a dielectric substrate with a ground plane;
- a dielectric resonator element arranged on the ground plane;
- a conductive feeding assembly operable to excite one or more dielectric resonator modes of the dielectric resonator element for generation of a first circularly polarized electromagnetic field, wherein the feeding assembly comprises:
  - a feeding network arranged to excite a first dielectric resonator mode of the dielectric resonator element, the feeding network comprises an substantially planar antenna that includes:
    - a central conductive portion;
    - a plurality of conductive stub portions extending radially from the central conductive portion; and
    - a plurality of conductive arc portions each extending circumferentially from a respective conductive stub portion; and
- a feeding probe arranged to excite a second dielectric resonator mode of the dielectric resonator element; and
- a radiating arrangement operable to produce a second circularly polarized electromagnetic field complementary to the first circularly polarized electromagnetic field;
- wherein the first and second circularly polarized electromagnetic fields, when combined, are arranged to provide a unilateral circularly polarized electromagnetic field.

2. The dielectric resonator antenna of claim 1, wherein the first dielectric resonator mode is $TE_{01\delta+1}$ mode.

3. The dielectric resonator antenna of claim 1, wherein the second dielectric resonator mode is $TM_{01\delta}$ a mode.

4. The dielectric resonator antenna of claim 1, wherein the feeding assembly further comprises:
- a micro-strip feed line arranged to be connected with the feeding probe.

5. The dielectric resonator antenna of claim 4, wherein the feeding network is arranged on one side of the dielectric substrate with the ground plane, and the micro-strip feed line is arranged on an opposite side of the dielectric substrate.

6. The dielectric resonator antenna of claim 1, wherein the antenna comprises four conductive stub portions that are angularly spaced apart from each other.

7. The dielectric resonator antenna of claim 1, wherein the feeding probe comprises any of: a cylindrical probe, a conical probe, an inverted conical probe, stepped cylindrical probe, and a planar micro-strip folded monopole.

8. The dielectric resonator antenna of claim 1, wherein the feeding probe is at least partly arranged in a chamber defined in the dielectric resonator element.

9. The dielectric resonator antenna of claim 8, wherein the chamber defines a cylindrical space and the feeding probe has a cylindrical body.

10. The dielectric resonator antenna of claim 9, wherein the cylindrical space and the cylindrical body are co-axial.

11. The dielectric resonator antenna of claim 1, wherein the radiating arrangement comprises a slot antenna, a patch, or a dielectric resonator element.

12. The dielectric resonator antenna of claim 1,
- wherein the radiating arrangement comprises
- a slot antenna comprising a slot formed by or within the central conductive portion.

13. The dielectric resonator antenna of claim 1, wherein the slot is cross-shaped.

14. The dielectric resonator antenna of claim 1, wherein the dielectric resonator element comprises a cylindrical body.

15. The dielectric resonator antenna of claim 1, wherein the dielectric resonator antenna is arranged for WLAN applications.

16. The dielectric resonator antenna of claim 1, wherein a ratio of a footprint of the ground plane to a footprint of the dielectric resonator element is between 1 to 1.2.

17. A dielectric resonator antenna array comprising one or more the dielectric resonator antenna of claim 1.

18. A wireless communication system comprising one or more the dielectric resonator antenna of claim x.

19. A dielectric resonator antenna comprising:

a dielectric substrate with a ground plane;

a dielectric resonator element arranged on the ground plane;

a conductive feeding assembly operable to excite one or more dielectric resonator modes of the dielectric resonator element for generation of a first circularly polarized electromagnetic field, wherein the feeding assembly comprises:

a feeding network arranged to excite a first dielectric resonator mode of the dielectric resonator element, the feeding network comprises an antenna that includes:

a central conductive portion;

a plurality of conductive stub portions extending radially from the central conductive portion; and a plurality of conductive arc portions each extending circumferentially from a respective conductive stub portion; and a radiating arrangement operable to produce a second circularly polarized electromagnetic field complementary to the first circularly polarized electromagnetic field;

wherein the first and second circularly polarized electromagnetic fields, when combined, are arranged to provide a unilateral circularly polarized electromagnetic field.

* * * * *